US006994620B2

(12) United States Patent
Mills

(10) Patent No.: US 6,994,620 B2
(45) Date of Patent: Feb. 7, 2006

(54) METHOD OF DETERMINING STATIC PRESSURE IN A DUCTED AIR DELIVERY SYSTEM USING A VARIABLE SPEED BLOWER MOTOR

(75) Inventor: Eugene L. Mills, Avon, IN (US)

(73) Assignee: Carrier Corporation, Farmington, CT (US)

( * ) Notice: Subject to any disclaimer, the term of this patent is extended or adjusted under 35 U.S.C. 154(b) by 257 days.

(21) Appl. No.: 10/426,463

(22) Filed: Apr. 30, 2003

(65) Prior Publication Data

US 2004/0219875 A1 Nov. 4, 2004

(51) Int. Cl.
*F24F 11/00* (2006.01)

(52) U.S. Cl. ..... 454/255; 454/256
(58) Field of Classification Search ..... 454/255, 454/256
See application file for complete search history.

(56) References Cited

U.S. PATENT DOCUMENTS 4,941,113 A * 7/1990 Dundics et al. ..... 702/83
5,410,230 A * 4/1995 Bessler et al. ..... 318/471
6,046,441 A * 4/2000 Daffron ..... 219/506
6,076,739 A * 6/2000 Littleford et al. ..... 236/44 R

OTHER PUBLICATIONS

"Fan Airflow Recirculation Controller", *IBM Technical Disclosure Bulletin*, NN9408143, IBM Corporation, Aug. 1, 1994, pp. 143–146.*

* cited by examiner

*Primary Examiner*—Harold Joyce
(74) *Attorney, Agent, or Firm*—Wall Marjama & Bilinski LLP

(57) ABSTRACT

Systems and methods of determining static air pressure in an HVAC system are provided. Static air pressure is mathematically determined as a function of system parameters, such as blower speed, blower diameter, system volume airflow rate, and/or blower motor torque. The determined static pressure can be used during HVAC installation and during HVAC monitoring and maintenance.

18 Claims, 2 Drawing Sheets

METHOD OF DETERMINING STATIC PRESSURE IN A DUCTED AIR DELIVERY SYSTEM USING A VARIABLE SPEED BLOWER MOTOR

CROSS REFERENCE TO RELATED APPLICATIONS

None.

1. Field of the Invention

The invention relates generally to systems for, and methods of, precisely determining static fluid pressure, such as that of air, in a conduit system, such as a ducted air delivery system.

2. Background of the Invention

Modern structures, such as office buildings, manufacturing plants, barns, and residences, often are designed and constructed so as to allow control over environmental conditions within the structures. By way of example, environmental conditions such as temperature, humidity, air purity, air flow, enthalpy (combined value of temperature and humidity), and "fresh air" ventilation can be regulated to ensure that the interior environment of a structure is as may be desired for particular occupants and equipment housed in the structure, and for processes and procedures conducted within the structure.

In practice, one typical way of regulating environmental conditions within a building or other structure is by employing one or more duct systems to deliver processed air and, often, to remove air from within the building for processing. One common example of such a system is known as a heating, ventilating, and/or air conditioning (HVAC) system. HVAC systems generally are well-known, and a typical HVAC system can include, for example, components such as conduits ("ducts" or "duct systems"), air conditioners, compressors, heating elements, heat exchangers, filters, louvers (for controlling air flow to and from the exterior environment), blower fans, and airflow hoods. Simple HVAC systems can be designed employing a number of methods, including the equal friction method, the constant velocity method, the velocity reduction method, and the static regain method.

Part of designing an efficient HVAC system entails properly balancing airflow, so that pressure differences at different points in the HVAC ducts do not create undesirable situations, such as, for example, cooling or heating one particular area of an environment without adequately cooling or heating another area. The air duct system and fan interact, and often through trial-and-error, a balance of airflow is achieved. The trial-and-error entails, for example, balancing HVAC zoning systems using airflow hoods in a time consuming, iterative manner to measure the air delivery at each supply. Inefficient bypass and dump zones often are provided in zoning applications to regulate the air delivery when available airflow is too great for small zones.

Further, because of structure-to-structure differences, no one HVAC duct system usually is optimally efficient for every structure. In practice, one approach to achieve some modicum of efficiency entails designing HVAC duct systems that are custom or near-custom, which is a costly and time-consuming process. Another approach, to minimize the amount of customization required for any given structure, involves using HVAC duct systems that are designed, to the extent possible, to allow use (without substantial modification) in a wide range of structures. Such HVAC duct systems, however, often are inefficient, and require excessive testing and balancing to achieve tolerable efficiency.

Optimizing the efficiency of an HVAC system can be viewed in terms of optimizing at least one desired HVAC system parameter to approach or equal a desired value. Predominantly, regulation of an environment within a structure entails controlling the aerial environment of the structure's interior which, in turn, usually requires measuring (and then controlling) one or more system parameters associated with the HVAC system being used. Thus, where the parameter of interest is temperature, air temperature can first be measured by using, for example, simple thermometers, thermocouples, thermistors, resistance thermometers, and more recently, solid state devices for computerized measurements. Temperature can then be controlled by passing the air in the HVAC duct system over, through, or near, one or more heating elements (if the air is too cold), or over or near a cool, compressed fluid (if the air is too warm), until the air reaches a desired temperature.

Similarly, other system parameters can be measured and then regulated. Another such system parameter, static pressure, is especially useful in properly installing, and then monitoring and maintaining, HVAC systems. Static pressure can be used to optimize system operation, and also as a diagnostic measure during system installation and service. Static pressure can be widely variable from installation to installation due, in part, to varied duct system configurations and blower systems, which are designed to accommodate a range of applications. The static pressure of any ducted system can be measured using a manometer or similar low-pressure measurement device or transducer. Often such measurement devices and transducers require transport of the devices by technicians to an HVAC installation and temporary installation for use. In addition, such static pressure measurement devices can require specialized configurations, with transducers projecting into the HVAC conduits and artificial flow restrictions (e.g., dampers), for accurate measurement.

It would thus be desirable to have methods and devices for determining a parameter associated with the HVAC duct system, such as the static pressure of air in an HVAC duct system, without the need for specialized instrumentation. It would further be desirable to allow measurement of static pressure automatically, without the need for a human presence in connection with the measurement. It would further be desirable to determine static pressure using an efficient method which minimizes the processing required of a controller element of an HVAC system.

SUMMARY OF THE INVENTION

In accordance with the present invention, there are provided devices and methods for calculating a parameter associated with a fluid which is flowing through a conduit.

Thus, according to one aspect of the invention, devices and methods are provided for calculating static air pressure in an HVAC duct system.

According to another aspect of the invention, methods of determining the model to be used by an HVAC system control are provided.

According to yet another aspect of the invention, a model to be used by an HVAC system controller that is efficient in terms of required microprocessor storage and execution is provided.

According to a further aspect of the invention, control of the operation of an HVAC system by an HVAC system controller implementing an efficient model of calculating static air pressure is provided.

DETAILED DESCRIPTION OF THE PREFERRED EMBODIMENT

Figure 1:
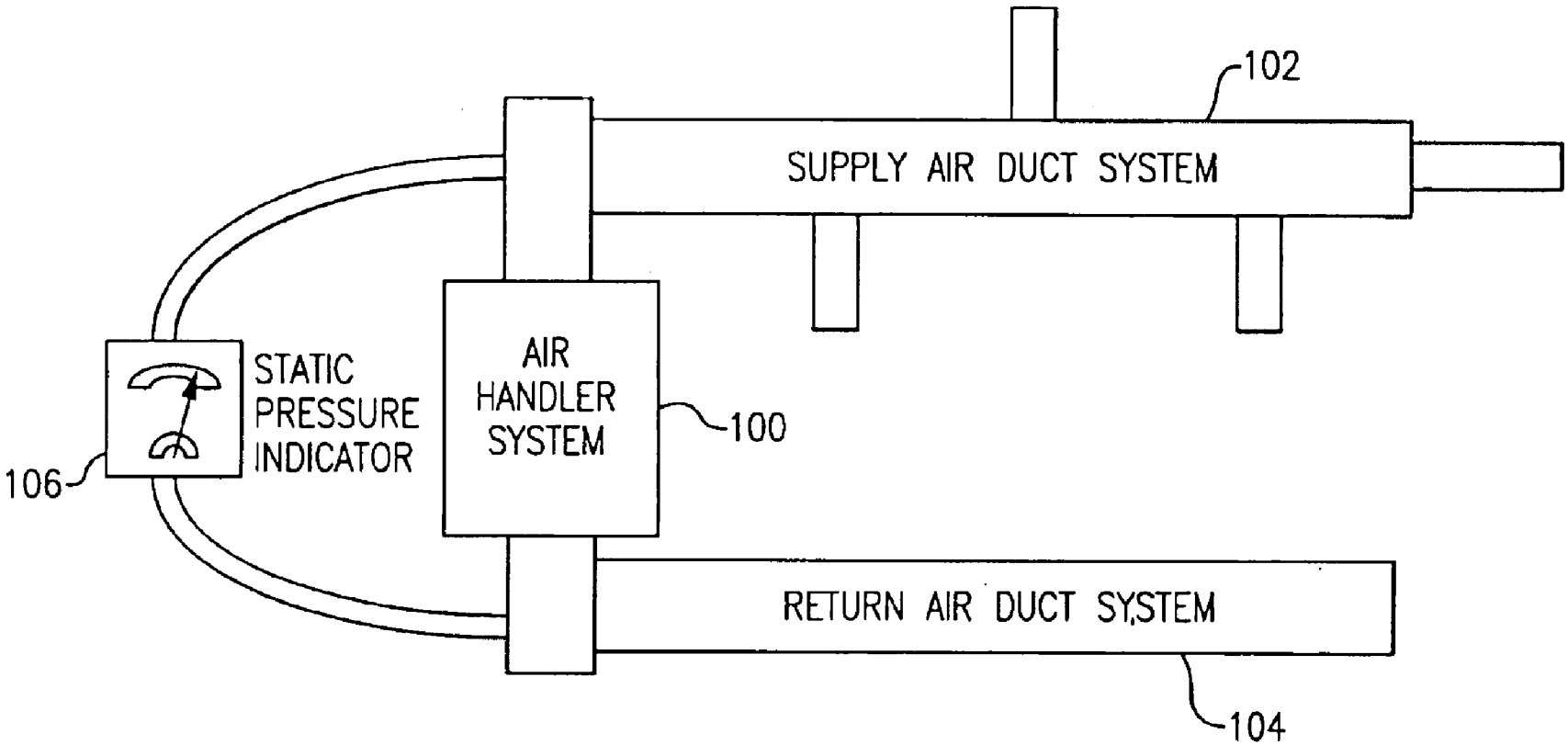
FIG. 1 Prior Art
FIG. 1 is a schematic of a typical, prior-art HVAC system.

It is to be understood that the invention is not limited in its application to the details of construction and arrangements of components set forth herein in the detailed description of the preferred embodiment or illustrated in the drawings. The invention is capable of other embodiments and of being practiced or being carried out in various ways.

FIG. 1 describes, at a high-level, a typical HVAC system. Referring to FIG. 1, such a system employs a supply air duct system 102, a return air duct system 104, and an air handler system 100. The prior art system also employs one or more static pressure measurement/indicator devices, represented as instrument 106 in FIG. 1, to ascertain the static pressure of air moving through the system. As discussed above, such instruments are undesirable as requiring human participation and, often, special installation.

Figure 2:
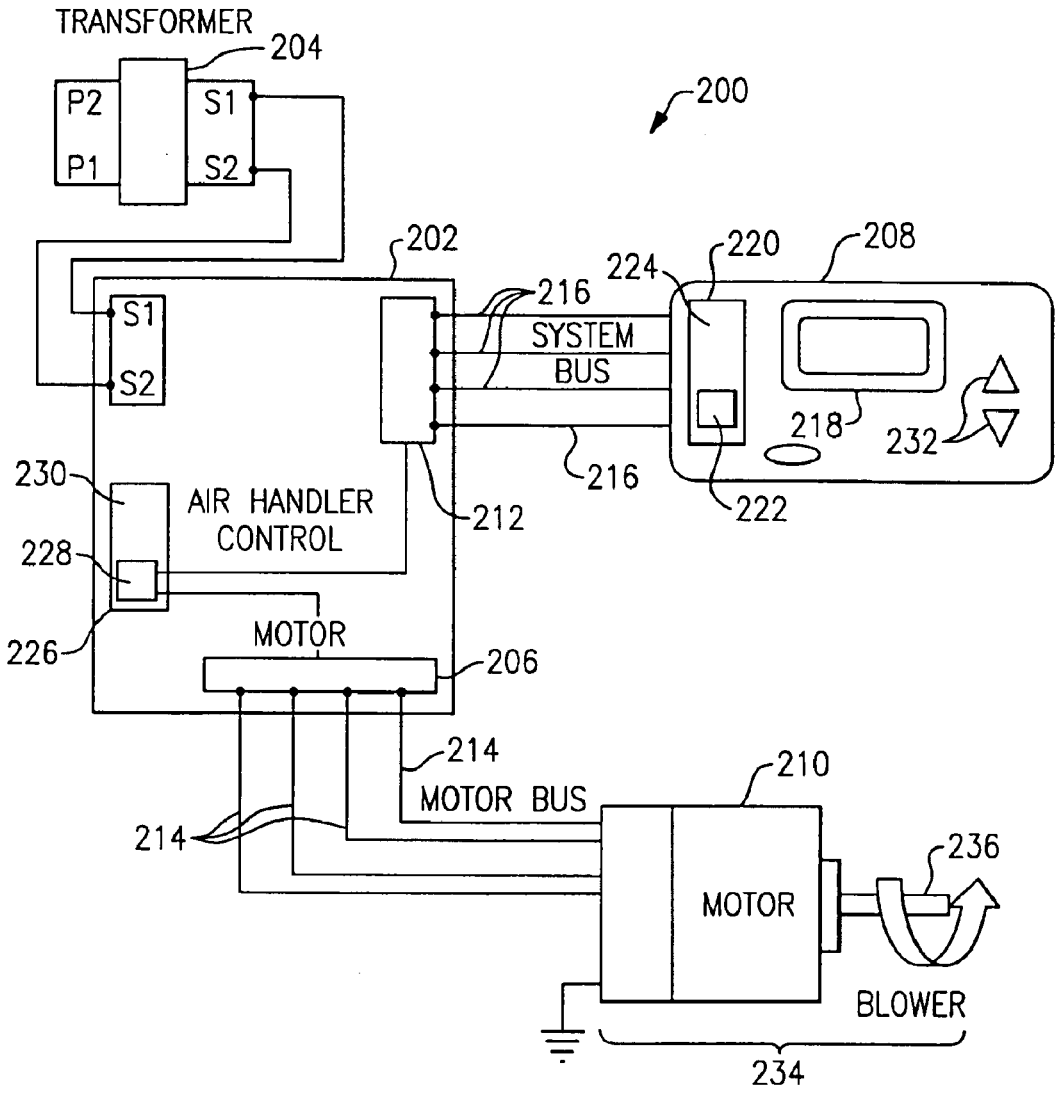
FIG. 2 is a component diagram of an HVAC system configured according to the present invention.

FIG. 2 illustrates an HVAC system 200 constructed in accordance with the present invention. Referring to FIG. 2, the HVAC system 200 can include an air handler control 202, a system control element 208, and a blower system 234 which includes a motor 210 and a blower 236. The system control element 208 is shown in direct communication with the air handler control 202, and the air handler control 202 is shown in direct communication with the motor 210 of the blower system 234. Optionally, the HVAC system 200 can include a transformer 204, for ensuring that proper voltage is applied to the HVAC system 200.

In the illustrative embodiment, the air handler control 202 includes an air handler controller 226, which includes a processor 228 and a memory 230 for storing certain operational characteristics particular to the given HVAC system 200, which will be described in greater detail later. As shown, the air handler controller 226 can be in communication with a model control and feedback circuit 212 and with a motor control and feedback circuit 206. Circuit 212 serves to connect the air handler control 202 to the system control element 208 by means of a system bus 216, and allows signals to be communicated between the air handler control 202 and the system control element 208. Circuit 206 connects the air handler control 202 to the motor 210, and serves to transmit commands to, and receive operation feedback from, the motor 210 by means of a motor bus 214.

The blower system includes a motor 210, which has an operational motor torque, and a blower 236, which has a blower diameter and an operational blower speed. The motor 210 serves to impel blades or other means of the blower 236 (not shown) to move air through the duct system (not illustrated) associated with HVAC system 200. The motor 210 preferably is a variable speed motor, of the type sold by Carrier Corporation of Farmington, Conn., in connection with its variable speed furnaces. The motor 210 receives operation requests in the form of an operating airflow volume over the motor bus 214 from the air handler control 202, and reports back its operating speed via the motor bus 214 to the air handler control 202.

The system control element 208 includes a computing element 220. The Computing element 220 includes a microprocessor 222 and a memory 224, and may be, for example, a computer, a personal digital assistant (PDA), an electronic thermostat, or any other device with the capability of storing and reading input data, performing calculations, and reporting the results of calculations. The system control element 208 preferably has a user interface element 218, such as a graphic user interface (GUI), a CRT display, a LCD display, or other means by which a user of the HVAC system 200 can be apprised of system status and/or particular characteristics of the system (such as static pressure). The system control element 208 also optionally has a user input element 232, such as a keypad, keyboard, or other data input means, which allows a user of the HVAC system 200 to change the operation of the HVAC system 200.

In the illustrative embodiment, static pressure drop in a section of the HVAC system 200 external to the air handler section is determined by the system control element 208, though the determination of static pressure could be performed at any number of locations in the HVAC system 200, such as at the air handler control 202. In order for system control element 208 to determine static pressure in the illustrative embodiment shown, system control element first receives a value for system volume airflow rate (of air flowing through the HVAC system 200) and values for blower diameter and blower speed from the air handler control 202 over the system bus 216. The values for system volume airflow rate, blower diameter, and blower speed could be stored in the memory 224 of the system control element 208 long before calculation, though for greatest accuracy, it is preferred that these values, especially for system volume airflow rate and blower speed, are received at the system control element 208 from the air handler control 202 contemporaneously, or nearly contemporaneously, with the determination of static pressure by the system control element 208.

The preferred method of calculating static pressure begins with the use of performance parameters for fan systems (though other parameters could be employed, such as motor torque and blower speed, either calculated or obtained from look-up tables). These parameters are used to predict fan and blower performance, and form the basis for the widely accepted "fan laws". The parameters used are:

$$\text{Flow Coefficient: } \phi=700*(Q/ND^3) \quad (1)$$

$$\text{Pressure Coefficient: } \psi=8.752\times10^{6}*(P_s/\rho N^2D^2) \quad (2)$$

$$\text{Power Coefficient: } \lambda=3.915\times10^{13}*(BHP/\rho N^3D^5) \quad (3)$$

where: Q=the system volume airflow rate (cfm)

D=the blower diameter (inches)

N=the blower speed (rpm)

$\rho$=the density of the air (lb/ft$^3$)

$P_s$=the system total or external static pressure (inches water column)

BHP=the fan input horsepower

The pressure coefficient plotted against the flow coefficient describes the blower pressure performance, and can be used to predict the static pressure developed at any operating condition of N revolutions per minute (rpm), Q cubic feet per minute (cfm), and air density (lb/ft$^3$). The power coefficient is not believed to affect this model and is neglected from this point forward.

The flow-pressure relationship is determined using airflow performance tables (describing N, Q, and power vs. static pressure) which are experimentally measured for any given HVAC installation using, for example, the procedures and apparatus described in ASHRAE (American Society of Heating, Refrigerating, and Air-Conditioning Engineers, Inc.) Standard 37-1988, Methods of Testing for Rating Unitary Air-Conditioning and Heat Pump Equipment (ANSI approved), the disclosure of which is incorporated by reference herein. The flow and pressure coefficients are calculated using equations (1) and (2), and the pressure coefficient is regressed against the flow coefficient. The calculation of these constants can be pre-determined for any particular HVAC system with an air handler. The resultant for the pressure coefficient equation is a polynomial whose coefficients are the empirically determined pressure equation coefficients:

$$\psi=p_3\phi^3+p_2\phi^2+p_1\phi+p_0 \quad (4)$$

While the example provided herein is shown as a third order polynomial, one of ordinary skill will appreciate that higher order polynomials could be generated should greater accuracy be desired. Substituting the right hand side of equation (1) for $\phi$ in equation (4), and the right hand side of equation (2) for $\psi$ in equation (4), equation (4) can be mathematically reduced to an equation which, one of ordinary skill will appreciate, is a universal mathematical model which can be used to describe any air handler system. Solving for the static pressure term provides the desired model:

$$P_s=j_3*Q^3/N+j_2*Q^2+j_1*Q*N+j_0*N^2 \quad (5)$$

$$j_3=39.191*p_3*\rho/D^7 \quad (6)$$

$$j_2=5.599e^{-2}*p_2*\rho/D^4 \quad (7)$$

$$j_1=7.998e^{-5}*p_1*\rho/D \quad (8)$$

$$j_0=1.143e^{-7}*p_0*\rho*D^2 \quad (9)$$

where:

$P_s$ is the system total or external static pressure (inches water column).

Q is the system volume airflow rate (cfm)

N is the blower speed (rpm)

$\rho$ is the density of the air (lb/ft$^3$)

D is the blower diameter (inches)

$p_3$, $p_2$, $p_1$, and $p_0$ are the empirically determined pressure equation coefficients.

In operation, this model is stored as a series of instructions in memory 224, and used by the processor 222 in the system control element 208 to calculate $P_s$. As described above, the preferred model uses the four stored system pressure constants ($j_3$, $j_2$, $j_1$, $j_0$) for each model produced. In the illustrative embodiment, the four system pressure constants are stored in the memory 230 of the air handler controller 226, though the coefficients could also be stored in the memory 230. The system control element 208 calculates the static pressure $P_s$, and optionally displays the calculated pressure on the user interface element 218.

It should be noted that the preferred model described herein possesses certain advantages over other implementations using tables and additional calculation code, because such implementations require larger amounts of stored data to service the model. Increasing the storage requirements of the HVAC system 200 in such a fashion would force the use of larger, more expensive computing and storage devices. The preferred implementation is much more efficient in both execution and storage requirements, and minimizes the cost of the system control.

While the invention has been described in conjunction with a preferred embodiment, it is evident that numerous alternatives, variations, and modifications will be apparent to those skilled in the art in light of the foregoing description. Thus, it is understood that the invention is not to be limited by the foregoing illustrative details.

EQUIVALENTS

While the invention has been particularly shown and described with reference to specific embodiments, it should be understood by those skilled in the art that various changes in form and detail may be made therein without departing from the spirit and scope of the invention as defined by the appended claims.

What is claimed is:

1. A method for determining static pressure drop in a desired section of an HVAC system external to an air handler section of the HVAC system, said air handler section including a blower system with a motor, said blower system having an operational blower speed, said motor having an operational motor torque, and said air moving through said air handler section at a system volume airflow rate, comprising the steps of:

developing a mathematical model describing the air handler system;

pre-determining a set of constants representing performance characteristics unique to the air handler section; and using a microprocessor to apply the pre-determined set of constants and at least two parameters selected from the group of parameters consisting of operational blower speed, operational motor torque, and system volume airflow rate to the mathematical model, thereby generating a value for static pressure drop of air in the desired section of the HVAC system.

2. The method of claim 1, further comprising the step of notifying a user of the HVAC system of the determined static pressure.

3. A method for determining static pressure drop in a desired section of an HVAC system external to an air handler section of the HVAC system, said air handler section including a blower system with a motor, said blower system having an operational blower speed, said motor having an operational motor torque, and said air moving through said air handler section at a system volume airflow rate, comprising the steps of:

developing a mathematical model describing the air handler system;

pre-determining a set of constants representing performance characteristics unique to the air handler section; and using a microprocessor to apply the pre-determined set of constants and at least two parameters selected from the group of parameters consisting of operational blower speed, operational motor torque, and system volume airflow rate to the mathematical model, thereby generating a value for static pressure drop of air in the desired section of the HVAC system, wherein the at least two parameters are applied to the mathematical model comprising the following equation:

$$P_s=j_3*Q^3/N+j_2*Q^2+j_1*Q*N+j_0*N^2$$

where $P_s$ is the static pressure (inches water column), Q is the system volume airflow rate (cfm), N is the blower speed (rpm), and $j_3$, $j_2$, $j_1$, and $j_0$ are predetermined constants.

4. The method of claim 3, wherein the following equations are used to determine the predetermined constants:

$$j_3=39.191*p_3*\rho/D^7$$

$$j_2=5.599e^{-2}*p_2*\rho/D^4$$

$$j_1=7.998e^{-5}*p_1*\rho/D$$

$$j_0=1.143e^{-7}*p_0*\rho*D^2$$

where ρ is the density of air (lb/ft$^3$), D is the blower diameter (inches), and $p_3$, $p_2$, $p_1$, and $p_0$ are empirically determined pressure equation constants that characterize the air handler.

5. A control system for determining static pressure of air in an HVAC system, said air moving through said HVAC system at a system volume flowrate, said control system comprising:

a control element including a microprocessor and a memory;

a blower including a fan and a motor, said blower causing movement of said air through said HVAC system, said blower having an operational blower speed, and said motor having an operational motor torque;

wherein said control element is in communication with said blower system, and wherein said microprocessor of said control element implements a mathematical model to determine static pressure based on data received from said blower.

6. The control system of claim 5, wherein the mathematical model implemented is a universal mathematical model.

7. The control system of claim 5, wherein the motor is a variable speed blower motor.

8. The control system of claim 5, further comprising an air handler control in communication with both the control element and the blower.

9. The control system of claim 5, wherein the control element further comprises a user interface element for displaying the static pressure of the HVAC system.

10. The control system of claim 5, wherein the control element further comprises a user input element for allowing a user of the HVAC system to change the operation of the HVAC system.

11. The control system of claim 5, wherein a set of pre-determined constants and at least two of a set of system parameters are input to the mathematical model to determine static pressure, said set of system parameters consisting of: system volume airflow rate, blower speed, and motor torque.

12. The control system of claim 11, wherein the at least two system parameters input to the mathematical model are system volume airflow rate and blower speed.

13. A control system for determining static pressure of air in an HVAC system, said air moving through said HVAC system at a system volume flowrate, said control system comprising:

a control element including a microprocessor and a memory:

a blower including a fan and a motor, said blower causing movement of said air through said HVAC system, said blower having an operational blower speed, and said motor having an operational motor torque;

wherein said control element is in communication with said blower system, and said microprocessor of said control element implements a mathematical model to determine static pressure based on data received from said blower, wherein a set of pre-determined constants and at least two of a set of system parameters are input to the mathematical model to determine static pressure, said set of system parameters consisting of: system volume airflow rate, blower speed, and motor torque, wherein the at least two system parameters input to the mathematical model are system volume airflow rate and blower speed and wherein the mathematical model implemented by the microprocessor comprises the following equations:

$$P_s=j_3*Q^3/N+j_2*Q^2+j_1*Q*N+j_0*N^2$$

$$j_3=39.191*p_3*\rho/D^7$$

$$j_2=5.599\ e^{-2}*p_2*\rho/D^4$$

$$j_1=7.998e^{-5}*p_1*\rho/D$$

$$j_0=1.143e^{-7}*p_0*\rho*D^2$$

where $P_s$ is the static pressure (inches water column), Q is the system volume airflow rate (cfm), N is the blower speed (rpm), ρ is the density of the air (lb/ft$^3$), D is the blower diameter (inches), and $p_3$, $p_2$, $p_1$, and $p_0$ are empirically determined pressure equation coefficients.

14. A control system for regulating operation of an HVAC system in which air moves at a system volume flowrate, the control system comprising:

an air handler control;

a control element;

a blower for moving air through the HVAC system, the blower having a blower diameter and an operational blower speed;

wherein said air handler control is in direct communication with both the control element and the blower; and wherein the control element determines static pressure as a function of system volume flowrate, blower speed, and blower diameter.

15. The control system of claim 14, further comprising a user input interface for displaying the determined static pressure.

16. The control system of claim 14, further comprising a user input element for allowing a user of the HVAC system to change the operation of the HVAC system.

17. The control system of claim 14, wherein the control element receives the mathematical values of the system volume flowrate, the blower speed, and the blower diameter, from the air handler control.

18. The control system of claim 14, wherein the air handler control receives the mathematical value of the blower speed from the blower.

* * * * *